United States Patent [19]

Harada et al.

[11] Patent Number: 4,815,533

[45] Date of Patent: Mar. 28, 1989

[54] HEAT EXCHANGER

[75] Inventors: Shintaro Harada, Nishio; Yoshihira Shiroshita, Toyoake, both of Japan

[73] Assignee: Aisin Seiki Kabushiki Kaisha, Kariya, Japan

[21] Appl. No.: 170,679

[22] Filed: Mar. 16, 1988

Related U.S. Application Data

[63] Continuation of Ser. No. 20,132, Feb. 26, 1987, abandoned, which is a continuation of Ser. No. 733,744, May 14, 1985, abandoned.

[30] Foreign Application Priority Data

May 17, 1984 [JP] Japan ..... 59-099893

[51] Int. Cl.[4] ..... F28D 7/00; F28F 1/44

[52] U.S. Cl. ..... 165/159; 165/154; 165/165

[58] Field of Search ..... 165/154, 165, 179, 159

[56] References Cited

U.S. PATENT DOCUMENTS

| | | | |
|---|---|---|---|
| 3,409,075 | 11/1968 | Long | 165/154 |
| 3,491,184 | 7/1970 | Rietdijk | 165/165 |
| 4,147,210 | 4/1979 | Pronko et al. | 165/154 X |

FOREIGN PATENT DOCUMENTS

| | | | |
|---|---|---|---|
| 561073 | 6/1977 | U.S.S.R. | 165/165 |
| 2566 | of 1863 | United Kingdom | 165/165 |
| 775651 | 5/1957 | United Kingdom | 165/165 |

OTHER PUBLICATIONS

"An Ultra-Compact Low-Cost Heat Exchanger", Steyert and Stone, Cryogenics, Nov. 1978, vol. 18, No. 11.

*Primary Examiner*—Ira S. Lazarus
*Assistant Examiner*—Peggy Neils
*Attorney, Agent, or Firm*—Burns, Doane, Swecker & Mathis

[57] ABSTRACT

The invention relates to a heat exchanger, particularly a counter-flow heat exchanger for use in a Joule-Thomson refrigerator. The heat exchanger includes a casing having at least one pipe disposed therein which defines a first flow passage for conducting a first fluid. A second flow passage is provided between the pipe and the casing for conducting a second fluid in heat transfer relationship with the first fluid. A plurality of wire nets are provided along each of the two flow passages to facilitate heat transfer between the two respective fluids.

7 Claims, 1 Drawing Sheet

HEAT EXCHANGER

This application is a continuation of application Ser. No. 020,132 filed Feb. 26, 1987, now abandoned, which in turn is a continuation of application Ser. No. 733,744 filed May 14, 1985, now abandoned.

BACKGROUND AND SUMMARY OF THE INVENTION

The present invention relates to a heat exchanger and more particularly to a heat exchanger of the counter-flow type for use in a Joule-Thomson type of refrigerator.

A conventional heat exchanger of the counter-flow type is disclosed, for example, in Japanese Patent Publication No. 44-6313. This patent discloses a heat exchanger having a cylindrical casing which houses a plurality of stacked wire nets. A bonding agent in the form of annularly-shaped elements interconnects adjacent wire nets. The bonding elements together form a cylindrical wall which defines two separate flow passages within the casing. High temperature gas is passed through one of the two flow passages. Low temperature gas is passed through the second flow passage in a direction opposite that of the high temperature gas. Heat is transferred from the high temperature gas to the low temperature gas through the plurality of wire nets. However, because the wire which forms the net is of such a high gauge (small radius), the efficiency of heat transfer from the high temperature gas to the low temperature gas is relatively low.

Accordingly, it is an object of the present invention to improve the efficiency of heat transfer in counter-flow heat exchangers of the type disclosed in Japanese Patent Publication No. 44-6313. This object and others are achieved by employing a thin walled metal pipe in place of the cylindrical wall formed by the bonding agents of the heat exchanger disclosed in the Japanese patent reference. The present invention increases the efficiency of heat transfer in the heat exchanger from the high temperature fluid to the low temperature fluid due to the increased surface area for heat transfer.

The present invention relates to a heat exchanger having a casing and at least one pipe disposed within the casing. Two flow passages are provided within the casing for directing the flow of fluid through the heat exchanger. A first flow passage is defined within the pipe. A second flow passage is defined between the pipe and the casing. A plurality of wire nets are disposed within each of the flow passages in order to facilitate heat transfer between fluids passing through the passages.

BRIEF DESCRIPTION OF THE DRAWINGS

A preferred embodiment of the present invention will be described in greater detail with reference to the accompanying drawings, wherein like members bear like reference numerals, and wherein.

DETAILED DESCRIPTION OF THE PREFERRED EMBODIMENT

Figure 1:
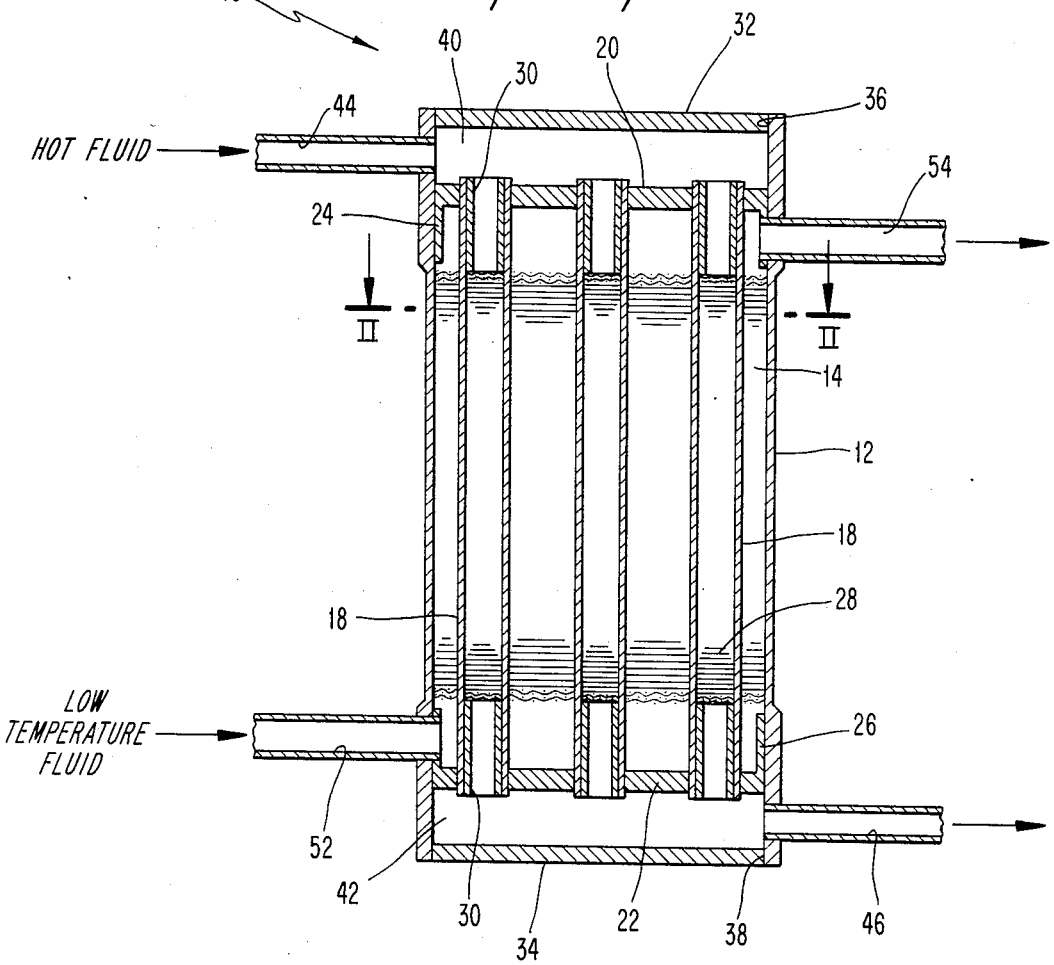
FIG. 1 is a cross-sectional view of a heat exchanger of the counter-flow type in accordance with the present invention.
Figure 2:
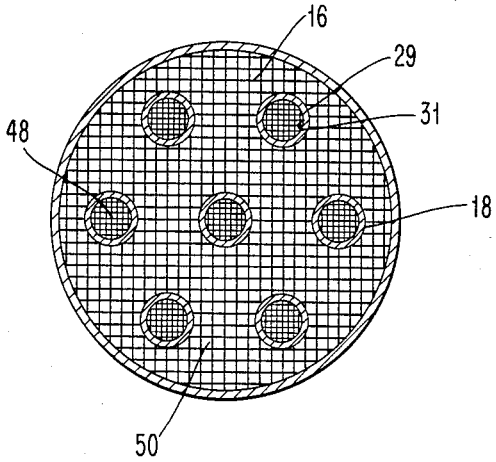
FIG. 2 is a sectional view taken along the line II—II of FIG. 1.

With reference to FIGS. 1 and 2, a heat exchanger 10 includes a casing 12 in the form of a cylinder. The casing 12 surrounds a plurality of stacked wire nets 14 that extend generally perpendicularly to the major axis of the casing 12. The wire nets 14 are formed from interwoven wires 16. Each wire net 14 preferably has a thickness which is approximately 1.5 to 2.2 times the radius of the wires 16.

The casing 12 is provided with a plurality of thin-walled metal pipes 18 (in the illustrated embodiment, seven pipes 18 are provided). The pipes 18 are arranged substantially parallel to the major axis of the casing 12 and extend through the wire nets 14. Ends of the pipes 18 are secured to upper and lower plates 20, 22. The wire nets 14 are secured between a first boss 24 integral with the upper plate 20 and a second boss 26 integral with the lower plate 22 and are preferably arranged in a closely spaced, dense stack, i.e., the nets are closely spaced from one another to present the maximum heat exchange surface area within the given volume.

Disposed within each pipe 18 is a plurality of closely spaced wire nets 28 arranged in a closely spaced stack which extends across the cross-section of the pipes 18. The stack arrangement of wire nets 28 provides a minimum separation distance between adjacent nets in order to maximize the surface area of wire net within the tubes 18 available for heat exchange. The wire nets 28 resemble the stacked wire nets 14 through which the pipes 18 pass, with the exception of size. As with each wire net 14, each wire net 28 is formed from interwoven wires. Each wire net 28 preferably has a thickness which is approximately 1.5 to 2.2 times the radius of the wire forming the wire net. The wire nets 28 are held in place within the pipes 18 by plugs 30 positioned at each end of the pipes 18.

An outer surface 29 and an inner surface 31, respectively, of each pipe 18 are connected to the wire nets 14, 28 in a conventional manner, for example, by fusion welding.

An upper cap 32 and a lower cap 34 are respectively fitted in an upper opening 36 and a lower opening 38 of the casing 12. An upper chamber 40 is defined between the upper cap 32 and the upper plate 20. A lower chamber 42 is defined between the lower plate 22 and the lower cap 34. The upper chamber 40 includes an inlet port 44 which communicates with an outlet port 46 formed in the lower chamber 42 through first flow passages 48 defined by the interior of the pipes 18. Second flow passages 50 provide communication between an inlet port 42 located at a lower end of one side of the casing 12 and an outlet port 54 located at an upper end of an opposite side of the casing.

In operation, a first fluid, preferably gas at high temperature and pressure, is supplied to the heat exchanger 10 at the inlet port 44 in the upper chamber 40. This heated gas passes through the first flow passages 48 and out of the exchanger 10 through the outlet port 46 located in the lower chamber 42. A second fluid, such as gas at low temperature and pressure, passes through the inlet port 52 along one side of the heat exchanger 10, through the second flow passages 50 and out the outlet port 54 located along the opposite side of the heat exchanger. While the gas at high temperature and pressure passes through the first flow passages, the gas transfers heat to the wire nets 28 located within the pipes 18. This transferred heat passes through the thin metal walls of the pipes 18 and to the wire nets 14 located in the second flow passages. The second fluid passing through the second flow passages absorbs the heat transferred to the wire nets 14. Accordingly, heat exchanges between the fluids to reduce the temperature of the high temperature fluid passing through the first flow passages.

The principles, preferred embodiment and mode of operation of the present invention have been described in the foregoing specification. However, the invention which is intended to be protected is not to be construed as limited to the particular embodiment disclosed. The embodiment is to be regarded as illustrative rather than restrictive. Variations and changes may be made by others without departing from the spirit of the present invention. Accordingly, it is expressly intended that all such variations and changes which fall within the scope of the present invention as defined in the appended claims be embraced thereby.

What is claimed is:

1. A heat exchanger comprising:

an elongated casing;

first cap means for closing a first end of said casing;

second cap means for closing a second end of said casing, opposite said first end;

first plate means connected in said casing adjacent said first end for defining a first chamber with said first cap means;

second plate means connected in said casing adjacent said second end for defining a second chamber with said second cap means, and a third chamber being thereby defined between said first and second plate means;

one of a first inlet and a first outlet connected to each of said first and second chambers;

a second inlet and a second outlet connected to said third chamber;

a first plurality of wire nets free of spacers therebetween and arranged in a densely packed stack at a minimum separation distance in said third chamber;

a plurality of conduit means extending through said first wire nets and through said first and second plate means for conducting fluid between said first and second chambers;

a second plurality of wire nets free of spacers therebetween and arranged in a densely packed stack at a minimum separation distance in each of said conduit means;

plug means for densely packing the second plurality of wire nets over a predetermined distance within said conduit means; and first and second bosses for densely packing the first plurality of wire nets over a distance within said third chamber corresponding to said predetermined distance.

2. The heat exchanger of claim 1, wherein said first and second pluralities of wire nets are fusion welded to said conduit means.

3. The heat exchanger of claim 1, wherein each of said pluralities of wire nets is in the form of interwoven wires.

4. The heat exchanger of claim 3, wherein each of said pluralities of wire nets has a thickness which is 1.5 to 2.2 times the radius of the wire comprising said wire nets.

5. The heat exchanger of claim 3, wherein said conduit means are disposed substantially parallel to a major axis of said casing.

6. The heat exchanger of claim 5, wherein the wire nets are oriented substantially perpendicular to the major axis of said casing.

7. The heat exchanger of claim 1, wherein said plug means includes a pair of plugs positioned in the axial ends of each conduit means, said plugs densely packing the second plurality of wire nets in the conduit means.

* * * * *